US009873283B1

(12) United States Patent
Banov

(10) Patent No.: US 9,873,283 B1
(45) Date of Patent: Jan. 23, 2018

(54) COMPARTMENTALIZED AND TRANSPARENT JEWELRY BINDER AND ASSOCIATED USE THEREOF

(71) Applicant: Lubka Banov, Downers Grove, IL (US)

(72) Inventor: Lubka Banov, Downers Grove, IL (US)

( * ) Notice: Subject to any disclaimer, the term of this patent is extended or adjusted under 35 U.S.C. 154(b) by 0 days.

(21) Appl. No.: 15/423,931

(22) Filed: Feb. 3, 2017

Related U.S. Application Data

(60) Provisional application No. 62/290,602, filed on Feb. 3, 2016.

(51) Int. Cl.

| | |
|---|---|
| ***B42F 5/00*** | (2006.01) |
| ***A45C 11/16*** | (2006.01) |
| ***A45C 13/10*** | (2006.01) |
| ***B42F 13/20*** | (2006.01) |

(52) U.S. Cl.
CPC ..... *B42F 5/00* (2013.01); *A45C 11/16* (2013.01); *A45C 13/103* (2013.01); *B42F 13/20* (2013.01); *B42P 2241/02* (2013.01); *B42P 2241/06* (2013.01)

(58) Field of Classification Search
CPC ..... B42F 13/0006; B42F 7/06; B42F 11/00; A45C 13/02; A45C 3/02; A45C 13/103; A45C 11/16; A47F 7/02
USPC ..... 402/4
See application file for complete search history.

(56) References Cited

U.S. PATENT DOCUMENTS

| | | | | |
|---|---|---|---|---|
| 2,807,265 | A * | 9/1957 | Oliva | B42F 11/00 281/27.1 |
| 4,319,703 | A * | 3/1982 | Gann | D05C 1/065 206/388 |
| 5,209,344 | A * | 5/1993 | Smith | A45C 7/0095 206/466 |
| 6,109,442 | A * | 8/2000 | Roegner | A45C 11/00 150/106 |
| 6,183,157 | B1 * | 2/2001 | Brown | B42F 13/40 206/311 |
| 6,367,842 | B1 * | 4/2002 | Wien | B42F 13/0006 150/145 |
| 2006/0131206 | A1 * | 6/2006 | Kenney | A61B 50/31 206/570 |
| 2007/0210141 | A1 * | 9/2007 | Cosmano | B42F 7/025 229/76 |

(Continued)

*Primary Examiner* — Shin H Kim
(74) *Attorney, Agent, or Firm* — Najafi Law, PA; Ashkan Najafi

(57) ABSTRACT

A portable multi-ring binder includes a plurality of rings spaced along a linear axis, a first outer transparent sheet removably attached to the rings and having a first inner longitudinal side registered parallel to the linear axis, and a second outer transparent sheet removably attached to the rings and having a second inner longitudinal side registered parallel to the linear axis. Notably, each of the first outer transparent sheet and the second outer transparent sheet includes a plurality of transparent pockets configured to store and display the jewelry therein. A fastener is attached to the first outer transparent sheet and the second outer transparent sheet. A handle section is attached to the second outer transparent sheet and configured to be selectively displaced between extended and retracted positions relative to the first outer transparent sheet and the second outer transparent sheet.

17 Claims, 5 Drawing Sheets

(56) References Cited

U.S. PATENT DOCUMENTS

| | | | | |
|---|---|---|---|---|
| 2011/0052310 | A1* | 3/2011 | Jansen | B42F 13/0026 402/4 |
| 2013/0277247 | A1* | 10/2013 | Caruth | B65D 33/00 206/232 |
| 2015/0296944 | A1* | 10/2015 | LaCombe | A45C 11/16 206/6.1 |

* cited by examiner

COMPARTMENTALIZED AND TRANSPARENT JEWELRY BINDER AND ASSOCIATED USE THEREOF

CROSS REFERENCE TO RELATED APPLICATIONS

This is a non-provisional patent application that claims the benefit of U.S. provisional patent application No. 62/290,602 filed Feb. 3, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to jewelry storage and display cases and, more particularly, to a jewelry organizer, configured in the form of a four-ring binder, which is designed to store and display for wear: rings, earrings, necklaces, bracelets, and more, neatly and securely within its removable pocketed pages. Featuring transparent, easily fastened pockets, this product will provide consumers an organized, convenient, and protective means of storing and displaying jewelry whether at home or on-the-go, as well as prevent jewelry pieces from becoming lost, tangled, kinked, or damaged.

Prior Art

A favorite fashion accessory worn by men and women alike is jewelry. Donned by people from all walks of life, earrings, necklaces, bracelets, and rings complement a person's wardrobe and offer a simple means in which to express individual style. Regardless of whether one prefers understated pieces, such as a classic pearl necklace and stud earrings; handcrafted jewelry, including beaded bracelets and carved pendants; or flashy pieces, such as rhinestone necklaces and diamond encrusted rings, most people store their jewelry in the same manner: inside a jewelry box. Jewelry boxes are manufactured in a variety of shapes and sizes to meet the needs of individual consumers. Including everything from a child's "pop-up" ballerina musical jewelry box, to the simple, upright boxes found on dresser and vanity tables, jewelry boxes offer consumers an easy means of tucking away treasured heirlooms and simple costume pieces when not in use.

Although jewelry boxes are a practical item, many consumers find that using them is not without drawbacks. Specifically, those consumers who enjoy wearing chain necklaces, bracelets and comparable pieces often find that their jewelry can become easily tangled and disheveled when stored in a standard jewelry box. As can be imagined, opening a drawer in one's jewelry cabinet only to find that a favorite gold necklace is hopelessly knotted can be an extremely frustrating scenario.

Additionally, matching pieces such as earrings or cuff links can be difficult to keep together, resulting in a time-consuming search for a piece's companion. Moreover, while jewelry boxes can be easily utilized in the home, the very size and shape of these storage units make them impractical for travel use. As such, travelers must improvise, placing jewelry in a zippered cosmetic case or wallet, hoping that pieces will not become tangled or otherwise damaged during transport. Unfortunately, these makeshift methods typically do not work, rendering the jewelry damaged or ruined beyond repair. Worse, with such insecure storage of expensive pieces, it is not uncommon for travelers to lose their jewelry, a truly heartbreaking scenario.

Accordingly, a need remains for a jewelry binder and display in order to overcome at least one aforementioned shortcoming. The exemplary embodiment(s) satisfy such a need by providing a jewelry organizer configured in the form of a four-ring binder that is convenient and easy to use, lightweight yet durable in design, versatile in its applications, and designed for storing and displaying jewelry.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a jewelry organizer for storing and displaying jewelry. These and other objects, features, and advantages of the non-limiting exemplary embodiment(s) are provided by the jewelry organizer including a portable multi-ring binder having a plurality of coextensively shaped rings spaced apart along a linear axis, a first outer transparent sheet removably attached to the rings and having a first inner longitudinal side registered parallel to the linear axis, and a second outer transparent sheet removably attached to the rings and having a second inner longitudinal side registered parallel to the linear axis. Notably, each of the first outer transparent sheet and the second outer transparent sheet includes a plurality of transparent pockets configured to store and display the jewelry therein. The binder further includes a fastener attached to the first outer transparent sheet and the second outer transparent sheet wherein the fastener is configured to be selectively zipped and unzipped between closed and open positions, respectively. Advantageously, a handle section is attached to the second outer transparent sheet and configured to be selectively displaced between extended and retracted positions relative to the first outer transparent sheet and the second outer transparent sheet.

In a non-limiting exemplary embodiment, the handle section includes a compartment statically affixed to an inner surface of the second outer transparent sheet. Such a compartment has an open side faced towards the linear axis and registered parallel thereto, and a U-shaped handle configured to be linearly inserted and removed from the compartment.

In a non-limiting exemplary embodiment, the U-shaped handle traverses the linear axis and laterally extends beyond the second inner longitudinal side of the second outer transparent sheet.

In a non-limiting exemplary embodiment, when the first outer transparent sheet is affixed to the second outer transparent sheet and when the U-shaped handle is removed from the compartment, the U-shaped handle is exposed exterior of each the first inner longitudinal side and the second inner longitudinal side.

In a non-limiting exemplary embodiment, when the first outer transparent sheet is affixed to the second outer transparent sheet and when the U-shaped handle is inserted into the compartment, the U-shaped handle is hidden interior of each the first inner longitudinal side and the second inner longitudinal side.

In a non-limiting exemplary embodiment, the U-shaped handle has a central portion registered parallel to the linear axis as well as each the first inner longitudinal side and the second inner longitudinal side.

In a non-limiting exemplary embodiment, the compartment and the U-shaped handle are intermediately disposed between selected ones of the rings.

In a non-limiting exemplary embodiment, the compartment and the U-shaped handle are arranged in a planar configuration registered parallel to the first outer transparent sheet and the second outer transparent sheet at both the closed and open positions.

The present disclosure further includes a method of utilizing a jewelry organizer for storing and displaying jewelry. Such a method includes: providing a portable multi-ring binder by performing the following sub-steps: providing and spacing apart a plurality of coextensively shaped rings along a linear axis; providing a first outer transparent sheet having a first inner longitudinal side; removably attaching the first outer transparent sheet to the rings thereby registering the first inner longitudinal side parallel to the linear axis; providing a second outer transparent sheet having a second inner longitudinal side; and removably attaching the second outer transparent sheet to the rings thereby registering the second inner longitudinal side parallel to the linear axis. Notably, each of the first outer transparent sheet and the second outer transparent sheet includes a plurality of transparent pockets configured to store and display the jewelry therein.

The method further includes the sub-steps of: providing and attaching a fastener to the first outer transparent sheet and the second outer transparent sheet; providing and attaching a handle section to the second outer transparent sheet; providing, storing and displaying jewelry inside the transparent pockets; selectively zipping and unzipping the fastener between closed and open positions; and selectively displacing the handle section between extended and retracted positions relative to the first outer transparent sheet and the second outer transparent sheet.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
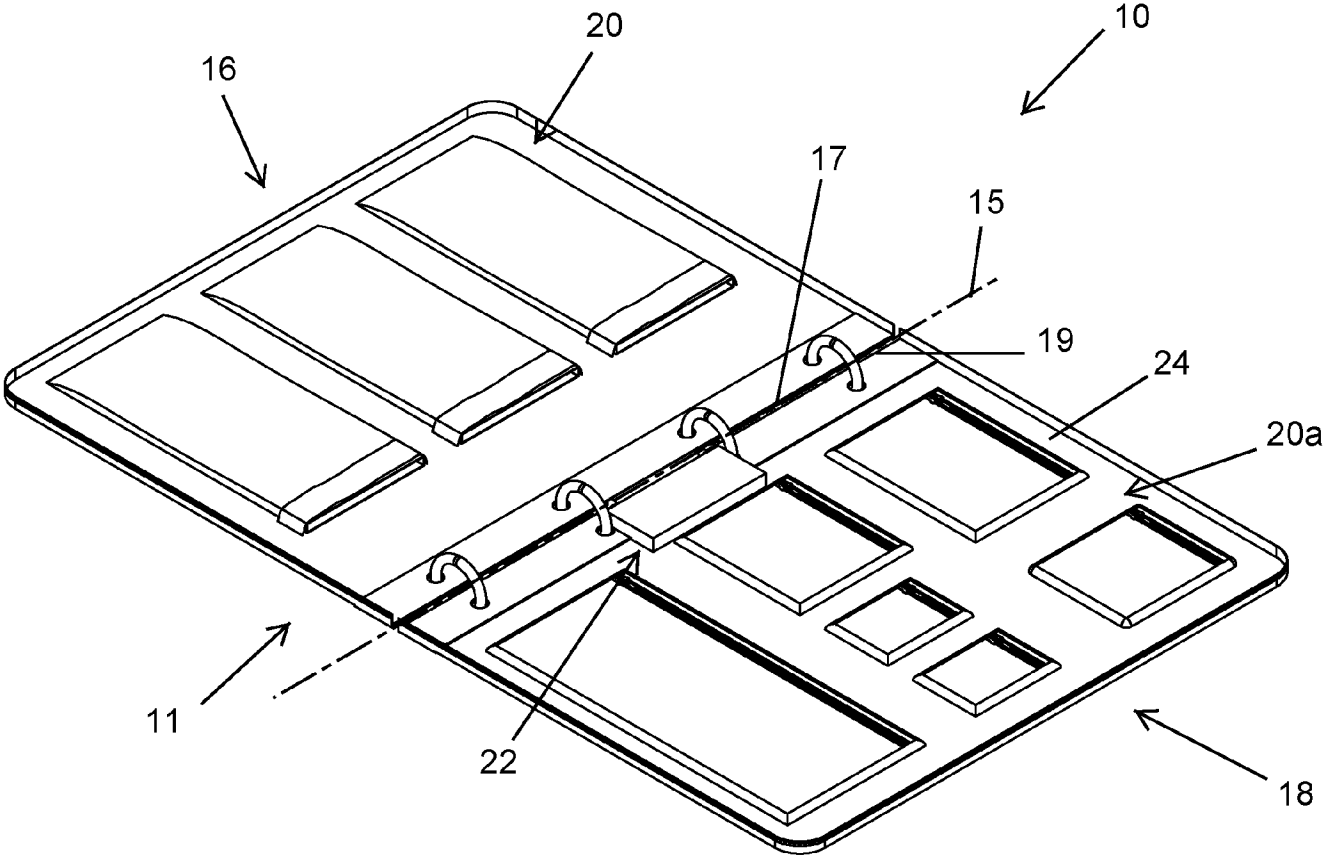
FIG. 1 is a perspective view of a compartmentalized and transparent jewelry binder unzipped at an open position having a handle section disposed at an extracted position, in accordance with a non-limiting exemplary embodiment.
Figure 2:
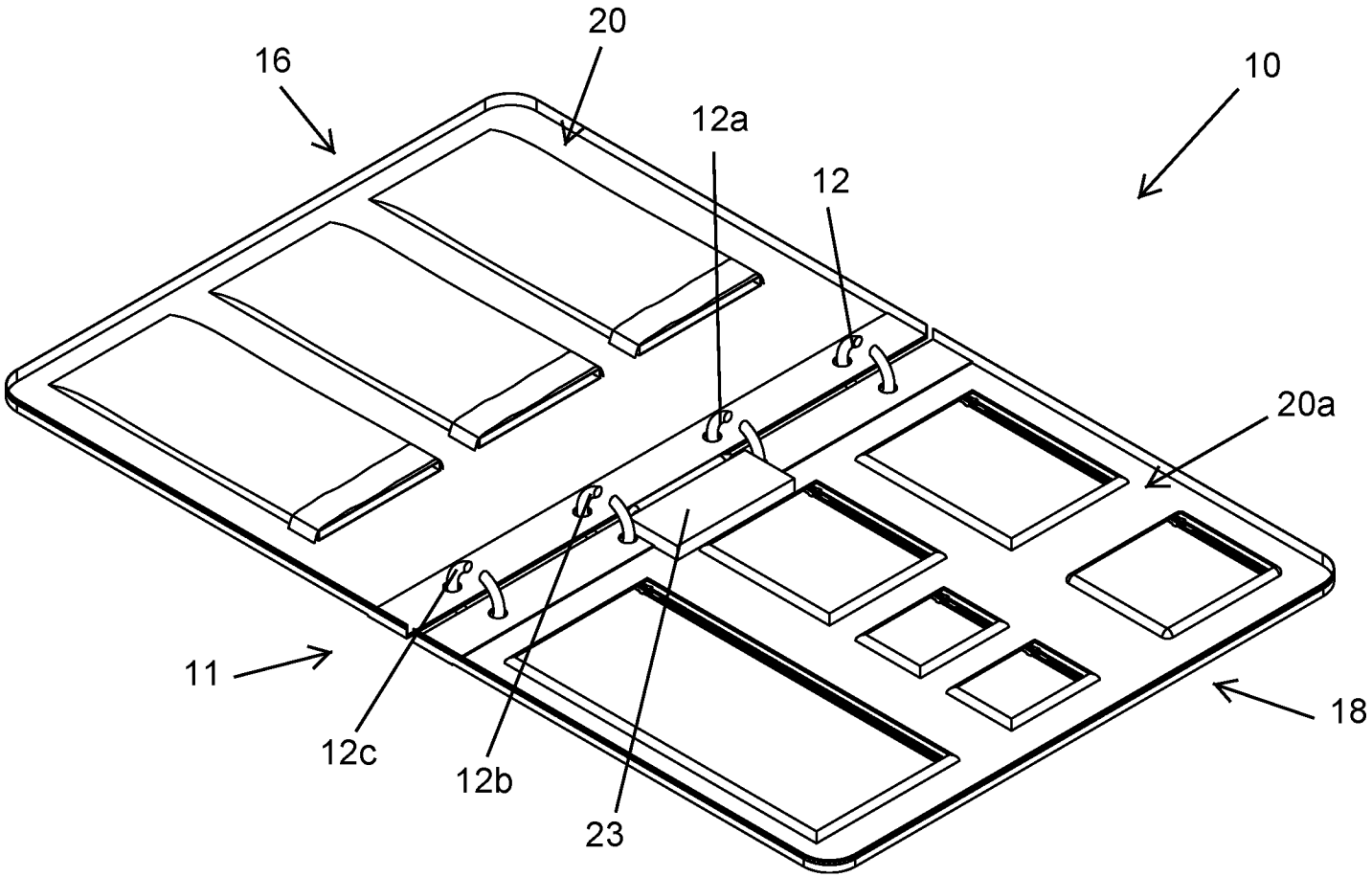
FIG. 2 is a perspective view of the binder shown in FIG. 1 wherein the rings are disposed at open positions.
Figure 3:
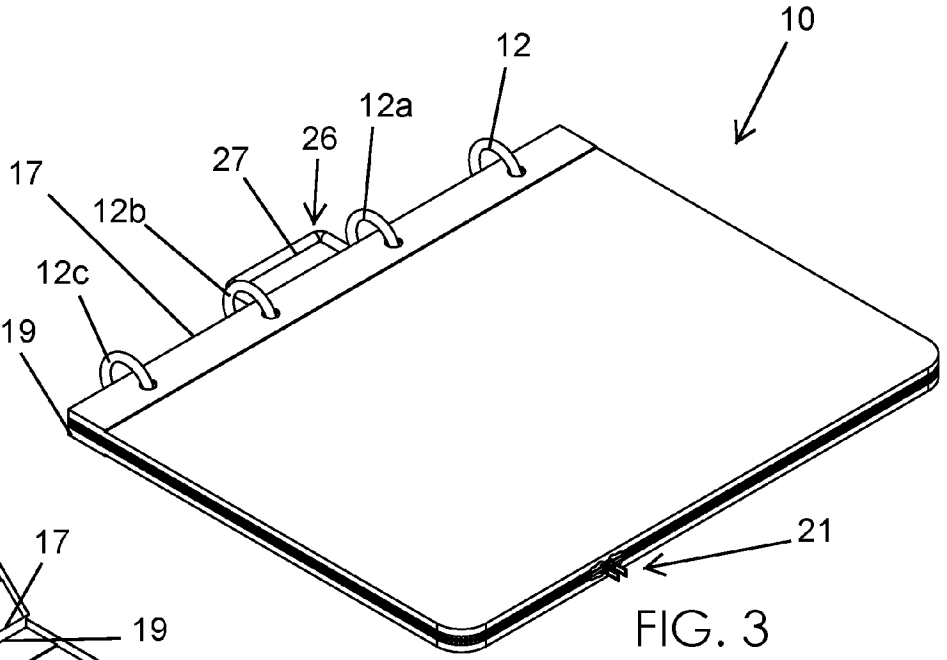
FIG. 3 is a perspective view of the binder shown in FIG. 1 wherein the fastener is zipped to a closed position and a U-shaped handle is exposed exterior thereof.
Figure 4:
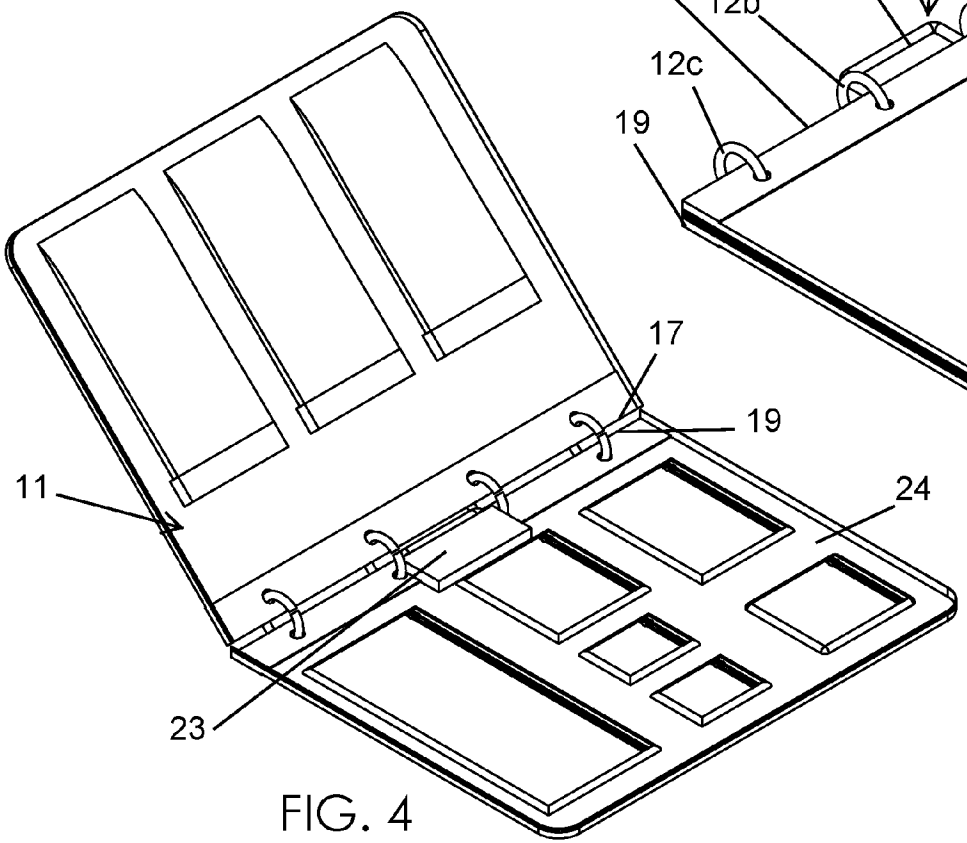
FIG. 4 is a perspective view showing the binder in FIG. 1 articulated to a partially open position.
Figure 5:
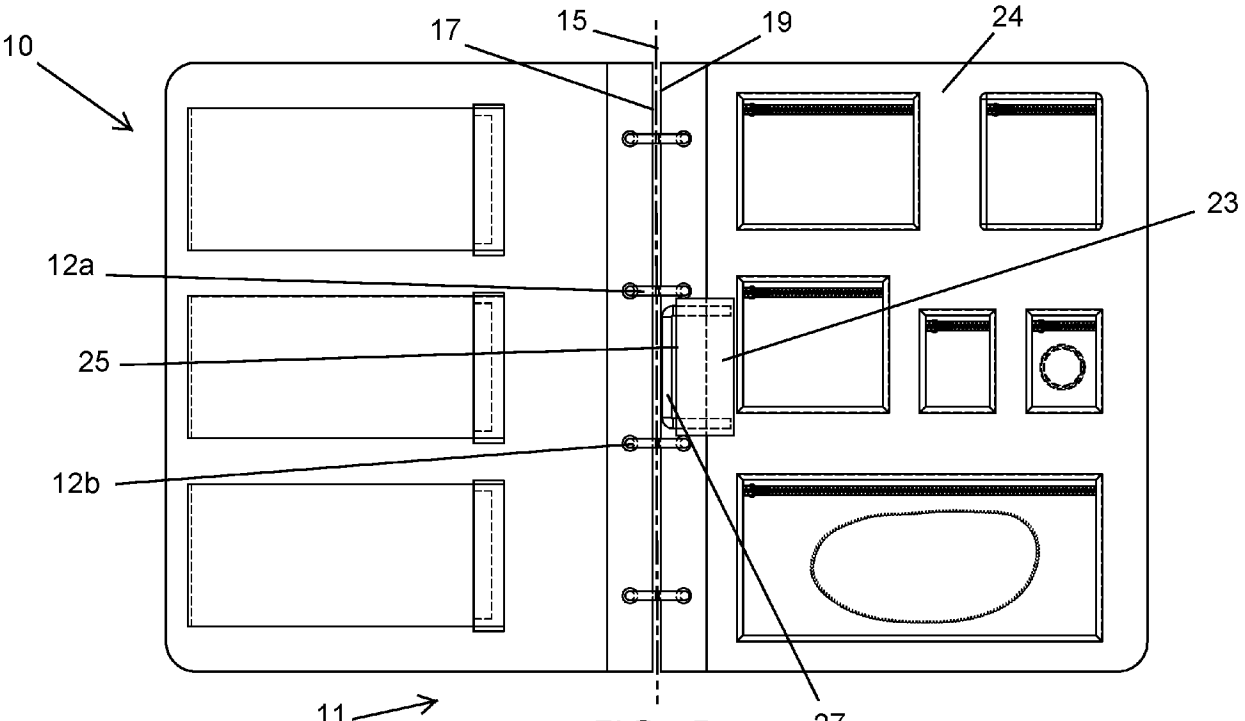
FIG. 5 is a top plan view of the binder shown in FIG. 1 wherein the U-shaped handle retracted into the compartment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-8 and is/are intended to provide a jewelry organizer 10 configured in the form of a four-ring binder 11 for storing and displaying jewelry. It should be understood that the exemplary embodiment(s) may be used to store and display a variety of jewelry, and should not be limited to any particular jewelry described herein.

Referring to FIGS. 1-8, the jewelry organizer 10 includes a portable multi-ring binder 11 having a plurality of coextensively shaped rings 12-12*c* spaced apart along a linear axis 15, a first outer transparent sheet 16 removably attached to the rings 12-12*c* and having a first inner longitudinal side 17 registered parallel to the linear axis 15, and a second outer transparent sheet 18 removably attached to the rings 12-12*c* and having a second inner longitudinal side 19 registered parallel to the linear axis 15. Notably, each of the first outer transparent sheet 16 and the second outer transparent sheet 18 includes a plurality of transparent pockets 20, 20*a* configured to store and display the jewelry therein. The binder 11 further includes a fastener 21 attached to the first outer transparent sheet 16 and the second outer transparent sheet 18 wherein the fastener 21 is configured to be selectively zipped and unzipped between closed and open positions, respectively. Advantageously, a handle section 22 is attached to the second outer transparent sheet 18 and configured to be selectively displaced between extended and retracted positions relative to the first outer transparent sheet 16 and the second outer transparent sheet 18 (e.g., FIGS. 3 and 5).

In a non-limiting exemplary embodiment, the handle section 22 includes a compartment 23 statically affixed to an inner surface 24 of the second outer transparent sheet 18. Such a compartment 23 has an open side 25 faced towards the linear axis 15 and registered parallel thereto, and a U-shaped handle 26 configured to be linearly inserted and removed from the compartment 23.

In a non-limiting exemplary embodiment, the U-shaped handle 26 traverses the linear axis 15 and laterally extends beyond the second inner longitudinal side 19 of the second outer transparent sheet 18.

In a non-limiting exemplary embodiment, when the first outer transparent sheet 16 is affixed to the second outer transparent sheet 18 and when the U-shaped handle 26 is removed from the compartment 23, U-shaped handle 26 is exposed exterior of each the first inner longitudinal side 17 and the second inner longitudinal side 19.

In a non-limiting exemplary embodiment, when the first outer transparent sheet 16 is affixed to the second outer transparent sheet 18 and when the U-shaped handle 26 is inserted into the compartment 23, U-shaped handle 26 is hidden interior of each the first inner longitudinal side 17 and the second inner longitudinal side 19.

In a non-limiting exemplary embodiment, the U-shaped handle 26 has a central portion 27 registered parallel to the linear axis 15 as well as each the first inner longitudinal side 17 and the second inner longitudinal side 19.

In a non-limiting exemplary embodiment, the compartment 23 and the U-shaped handle 26 are intermediately disposed between selected ones of the rings 12*a*, 12*b*.

Figure 6:
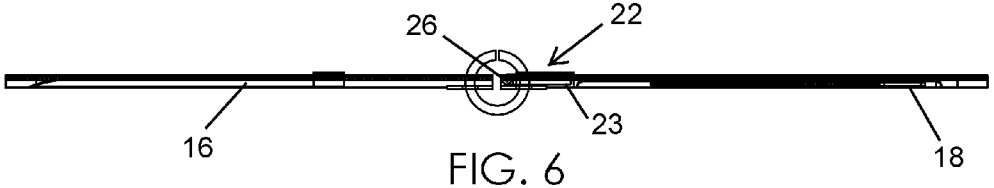
FIG. 6 is a front elevational view of the binder shown in FIG. 5.
Figures 7, 8:
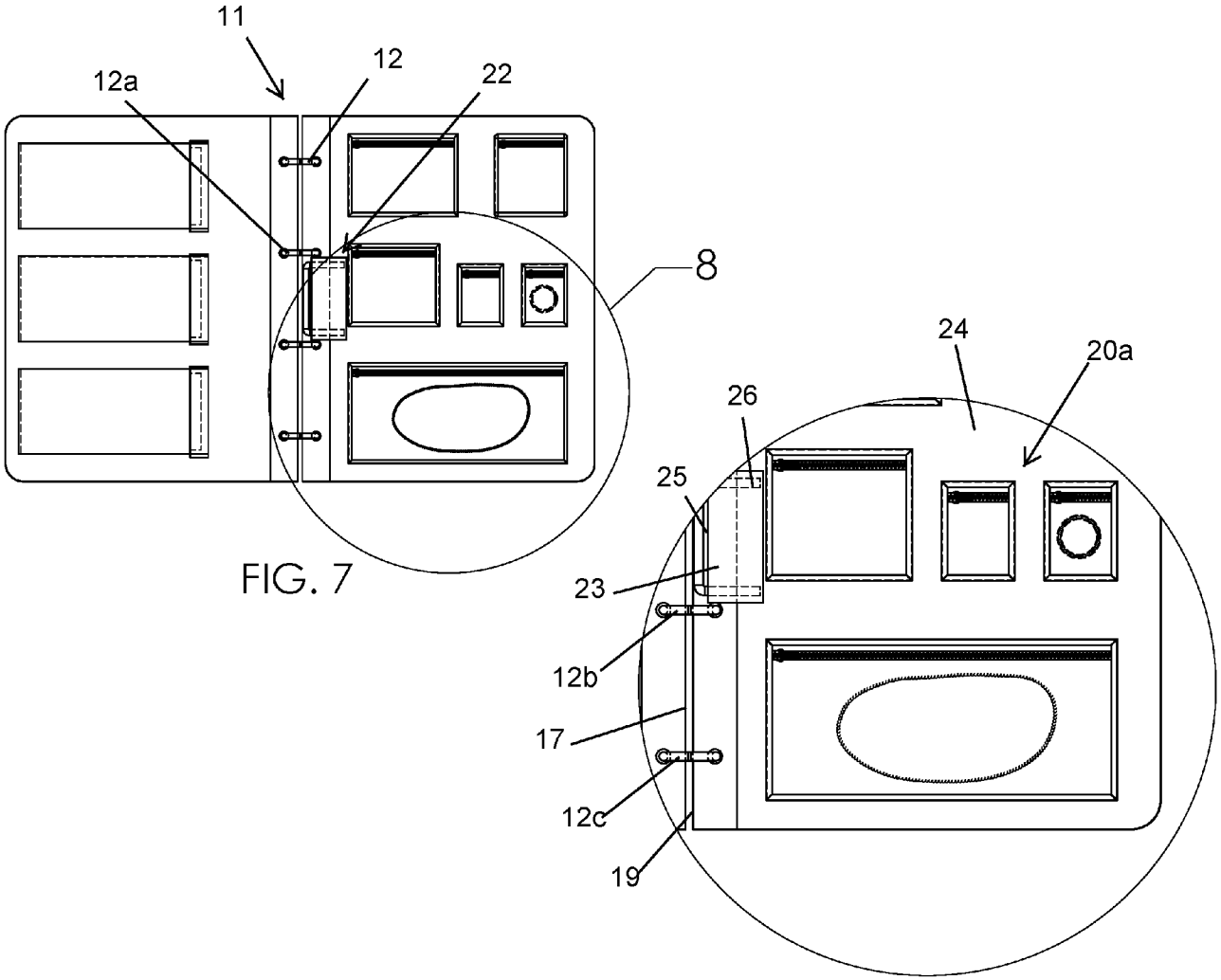
FIG. 7 is a reduced top plan view of the binder shown in FIG. 5.
FIG. 8 is an enlarged partial view showing the section identified in FIG. 7.

In a non-limiting exemplary embodiment, the compartment 23 and the U-shaped handle 26 are arranged in a planar configuration registered parallel to the first outer transparent sheet 16 and the second outer transparent sheet 18 at both the closed and open positions (e.g., FIG. 6).

The present disclosure further includes a method of utilizing a jewelry organizer 10 for storing and displaying jewelry. Such a method includes: providing a portable multi-ring binder 11 by performing the following sub-steps: providing and spacing apart a plurality of coextensively shaped rings 12-12*c* along a linear axis 15; providing a first outer transparent sheet 16 having a first inner longitudinal side 17; removably attaching the first outer transparent sheet 16 to the rings 12-12*c* thereby registering the first inner longitudinal side 17 parallel to the linear axis 15; providing a second outer transparent sheet 18 having a second inner longitudinal side 19; and removably attaching the second outer transparent sheet 18 to the rings 12-12*c* thereby registering the second inner longitudinal side 19 parallel to the linear axis 15. Notably, each of the first outer transparent sheet 16 and the second outer transparent sheet 18 includes a plurality of transparent pockets 20 configured to store and display the jewelry therein.

The method further includes the sub-steps of: providing and attaching a fastener 21 to the first outer transparent sheet 16 and the second outer transparent sheet 18; providing and attaching a handle section 22 to the second outer transparent sheet 18; providing, storing and displaying jewelry inside the transparent pockets 20; selectively zipping and unzipping the fastener 21 between closed and open positions; and selectively displacing the handle section 22 between extended and retracted positions relative to the first outer transparent sheet 16 and the second outer transparent sheet 18.

Referring to FIGS. 1-8 in general, in a non-limiting exemplary embodiment(s), the jewelry binder 11 is a specially designed storage unit for travel, as well as use, configured specifically to secure jewelry in a neater, more organized, and safer manner. As the name implies, the jewelry organizer 10 takes the form of a notebook-style binder 11, complete with clear plastic "sheets" that offer enclosed pockets 20 for housing appropriate jewelry items. Rectangular in shape, the jewelry binder 11 may measure approximately ten inches (10") in length, eight inches (8") in width, and one and one half inches (1½") in depth. The binder 11 may be a 3-ring notebook, featuring a heavy-duty plastic cover with spring loaded rings 12-12*c* along the interior spine of the binder 11.

Universal in construction, the jewelry binder 11 pages feature pockets 20 to house virtually any size or configuration of chain or bracelet, including but not limited to serpentine, box, link, or rope. Fashionable dainty watches, earrings and rings may be tucked into smaller storage pockets 20 as well, as the closures (offered in snap, zipper, or Velcro) are strong enough to secure these small items without fear of them falling out. To facilitate portability, a retractable handle section 22 is positioned on the spine of the jewelry binder 11, allowing the unit to be effortlessly carried. As an additional consideration, the jewelry binder 11 may be offered in a variety of colors and charming printed designs to appeal to individual tastes.

The jewelry binder 11 is a unique product which offers consumers many significant benefits and advantages. Foremost, this practical product stores a wide variety of accessory items in an efficient manner. Offering neat and organized storage for bracelets, anklets, and necklaces, and even rings, earrings, and watches, the jewelry binder 11 enables consumers to store dozens of jewelry items in an orderly and easily accessed fashion. A notebook-style organizer 10 boasting appropriately sized pockets 20 where the individual pieces are carefully separated, the jewelry binder 11 effectively prevents jewelry from becoming tangled, kinked, and otherwise damaged when stored during travel. Protecting fragile necklaces and bracelets from the knots and kinks that commonly occur when jewelry such as gold or silver chains, beaded bracelets, and pearls are stored in makeshift housing, the jewelry binder 11 protects the quality and appearance of the user's jewelry collection.

An invaluable accessory for those who wish to travel with their jewelry, the jewelry binder 11 ensures each piece is immaculately kept throughout any journey; additionally, the compact size would easily fit into a purse, backpack, or carry-on bag, ensuring instant access as well as secure placement so that the jewelry is not lost or misplaced. The lightweight the jewelry binder 11 does not add significant weight to luggage, yet is sturdy enough to withstand baggage handling. A thoughtful gift, the jewelry binder 11 proves a delightful present for any little girl or young teen. Durably constructed, the jewelry binder 11 will withstand years of use.

Practical and secure, the jewelry binder 11 enables consumers to easily store a wide variety of jewelry and accessory items in an efficient and safe manner. Offering a convenient organizational tool, this product is invaluable to any male or female consumer who enjoys wearing jewelry.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A jewelry organizer for storing and displaying jewelry, said jewelry organizer comprising:

a binder including a plurality of rings spaced apart along a linear axis, a first outer transparent sheet removably attached to said rings and having a first inner longitudinal side registered parallel to the linear axis, a second outer transparent sheet removably attached to said rings and having a second inner longitudinal side registered parallel to the linear axis, wherein each of said first outer transparent sheet and said second outer transparent sheet includes a plurality of transparent pockets configured to store and display the jewelry therein, a fastener attached to said first outer transparent sheet and said second outer transparent sheet, wherein said fastener is configured to be selectively zipped and unzipped between closed and open positions, respectively, and a handle section attached to said second outer transparent sheet and configured to be selectively displaced between extended and retracted positions relative to said first outer transparent sheet and said second outer transparent sheet.

2. The jewelry organizer of claim 1, wherein said handle section comprises:

a compartment statically affixed to an inner surface of said second outer transparent sheet, said compartment having an open side faced towards the linear axis and registered parallel thereto; and a U-shaped handle configured to be linearly inserted and removed from said compartment.

3. The jewelry organizer of claim 2, wherein said U-shaped handle traverses the linear axis and laterally extends beyond said second inner longitudinal side of said second outer transparent sheet.

4. The jewelry organizer of claim 3, wherein when said first outer transparent sheet is affixed to said second outer transparent sheet and when said U-shaped handle is removed from said compartment, said U-shaped handle is exposed exterior of each said first inner longitudinal side and said second inner longitudinal side.

5. The jewelry organizer of claim 4, wherein when said first outer transparent sheet is affixed to said second outer transparent sheet and when said U-shaped handle is inserted into said compartment, said U-shaped handle is hidden interior of each said first inner longitudinal side and said second inner longitudinal side.

6. The jewelry organizer of claim 5, wherein said U-shaped handle has a central portion registered parallel to the linear axis as well as each said first inner longitudinal side and said second inner longitudinal side.

7. The jewelry organizer of claim 2, wherein said compartment and said U-shaped handle are intermediately disposed between selected ones of said rings.

8. The jewelry organizer of claim 2, wherein said compartment and said U-shaped handle are arranged in a planar configuration registered parallel to said first outer transparent sheet and said second outer transparent sheet at both said closed and open positions.

9. A jewelry organizer for storing and displaying jewelry, said jewelry organizer comprising:

a portable multi-ring binder including a plurality of coextensively shaped rings spaced apart along a linear axis, a first outer transparent sheet removably attached to said rings and having a first inner longitudinal side registered parallel to the linear axis, a second outer transparent sheet removably attached to said rings and having a second inner longitudinal side registered parallel to the linear axis, wherein each of said first outer transparent sheet and said second outer transparent sheet includes a plurality of transparent pockets configured to store and display the jewelry therein, a fastener attached to said first outer transparent sheet and said second outer transparent sheet, wherein said fastener is configured to be selectively zipped and unzipped between closed and open positions, respectively, and a handle section attached to said second outer transparent sheet and configured to be selectively displaced between extended and retracted positions relative to said first outer transparent sheet and said second outer transparent sheet.

10. The jewelry organizer of claim 9, wherein said handle section comprises:

a compartment statically affixed to an inner surface of said second outer transparent sheet, said compartment having an open side faced towards the linear axis and registered parallel thereto; and a U-shaped handle configured to be linearly inserted and removed from said compartment.

11. The jewelry organizer of claim 10, wherein said U-shaped handle traverses the linear axis and laterally extends beyond said second inner longitudinal side of said second outer transparent sheet.

12. The jewelry organizer of claim 11, wherein when said first outer transparent sheet is affixed to said second outer transparent sheet and when said U-shaped handle is removed from said compartment, said U-shaped handle is exposed exterior of each said first inner longitudinal side and said second inner longitudinal side.

13. The jewelry organizer of claim 12, wherein when said first outer transparent sheet is affixed to said second outer transparent sheet and when said U-shaped handle is inserted into said compartment, said U-shaped handle is hidden interior of each said first inner longitudinal side and said second inner longitudinal side.

14. The jewelry organizer of claim 13, wherein said U-shaped handle has a central portion registered parallel to the linear axis as well as each said first inner longitudinal side and said second inner longitudinal side.

15. The jewelry organizer of claim 10, wherein said compartment and said U-shaped handle are intermediately disposed between selected ones of said rings.

16. The jewelry organizer of claim 10, wherein said compartment and said U-shaped handle are arranged in a planar configuration registered parallel to said first outer transparent sheet and said second outer transparent sheet at both said closed and open positions.

17. A method of utilizing a jewelry organizer for storing and displaying jewelry, said method comprising: providing a portable multi-ring binder by performing the following sub-steps providing and spacing apart a plurality of coextensively shaped rings along a linear axis;

providing a first outer transparent sheet having a first inner longitudinal side;

removably attaching said first outer transparent sheet to said rings thereby registering said first inner longitudinal side parallel to the linear axis;

providing a second outer transparent sheet having a second inner longitudinal side;

removably attaching said second outer transparent sheet to said rings thereby registering said second inner longitudinal side parallel to the linear axis;

wherein each of said first outer transparent sheet and said second outer transparent sheet includes a plurality of transparent pockets configured to store and display the jewelry therein;

providing and attaching a fastener to said first outer transparent sheet and said second outer transparent sheet;

providing and attaching a handle section to said second outer transparent sheet;

providing, storing and displaying jewelry inside said transparent pockets;

selectively zipping and unzipping said fastener between closed and open positions; and selectively displacing said handle section between extended and retracted positions relative to said first outer transparent sheet and said second outer transparent sheet.

* * * * *